United States Patent [19]

Allemand

[11] Patent Number: 4,757,987

[45] Date of Patent: Jul. 19, 1988

[54] PORTABLE FOLDING TREADMILL

[76] Inventor: Donald R. Allemand, Rt. 1, Box 307H, Walla Walla, Wash. 99362

[21] Appl. No.: 1,521

[22] Filed: Jan. 8, 1987

[51] Int. Cl.[4] ..... A63B 23/06

[52] U.S. Cl. ..... 272/69

[58] Field of Search ..... 272/69, 130, 131, 132, 272/133, 70

[56] References Cited

U.S. PATENT DOCUMENTS

| | | | |
|---|---|---|---|
| 931,394 | 8/1909 | Day | 272/69 |
| 1,824,406 | 9/1931 | Petersime | 272/69 |
| 2,117,957 | 5/1938 | Heller | 272/69 |
| 3,642,279 | 2/1972 | Cutter | 272/69 |
| 3,650,529 | 3/1972 | Salm et al. | 272/69 |
| 4,066,257 | 1/1978 | Moller | 272/69 |
| 4,538,804 | 9/1985 | Zibell | 272/132 X |
| 4,659,077 | 4/1987 | Stopkay | 272/70 X |

FOREIGN PATENT DOCUMENTS

| | | | |
|---|---|---|---|
| 1057928 | 5/1959 | Fed. Rep. of Germany | 272/69 |
| 1478027 | 7/1969 | Fed. Rep. of Germany | 272/69 |

*Primary Examiner*—Richard J. Apley
*Assistant Examiner*—David Bender
*Attorney, Agent, or Firm*—Gilden & Israel

[57] ABSTRACT

A portable treadmill exercising apparatus is foldable into a compact size when not being utilized. The treadmill includes the use of telescoping handles which, when collapsed, release the tension on the treadmill belt so that the unit can be folded in half.

4 Claims, 4 Drawing Sheets

FIG 2
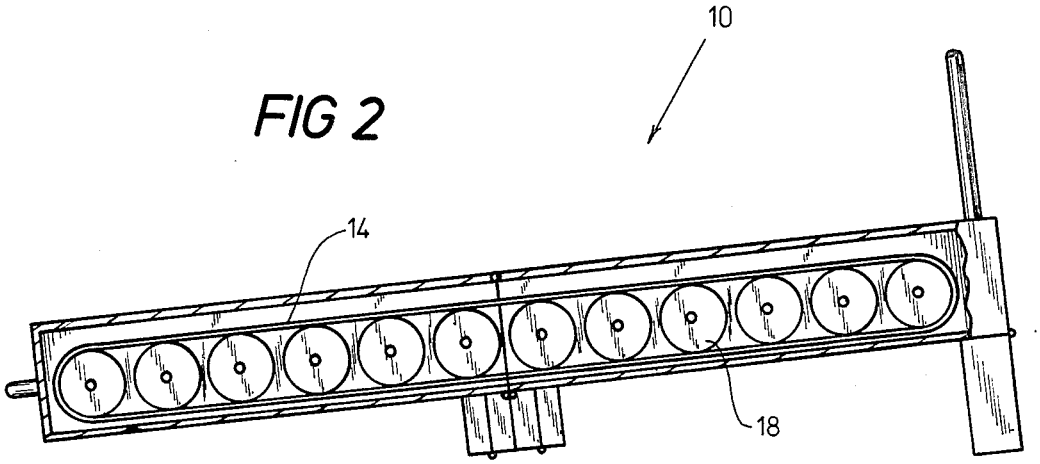
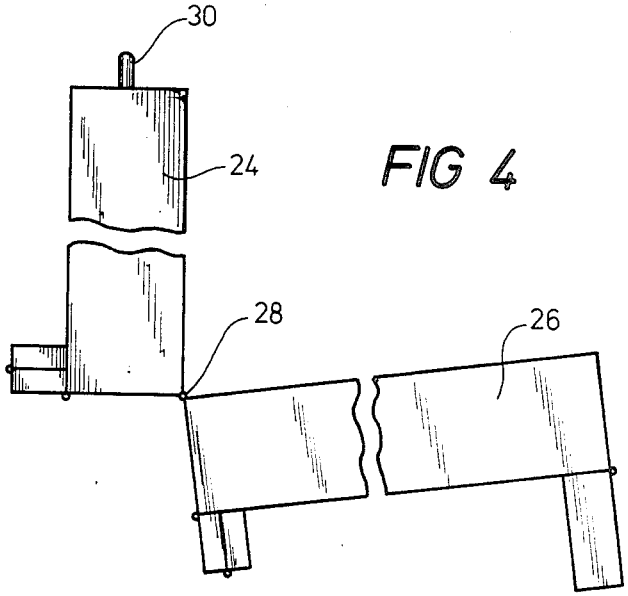
FIG 4

PORTABLE FOLDING TREADMILL

BACKGROUND OF THE INVENTION

1. Field of the Invention

The present invention relates to exercising devices, and more particularly pertains to a new and improved treadmill exercising device which, when not being utilized, may be folded into a compact size for transporting or storing the same.

2. Description of the Prior Art

The use of treadmill exercising apparatuses is well known in the prior art. As can be appreciated, these devices usually require a substantial amount of space and as such, it is desirable to store the devices when they are not being utilized. In this connection, there have been several attempts to develop treadmill exercising devices which may be easily and efficiently stored when desired. For example, U.S. Pat. No. 3,642,279, which issued to J. Cutter on Feb. 15, 1972, discloses a treadmill jogger which includes a collapsible handle and which is further designed to be raised into a vertical position for storage against a wall during periods of non-use. While being a functional solution for storage during periods of user inactivity, the Cutter treadmill is not particularly adapted for easy movement whereby a user thereof could easily transport the treadmill to a separate location.

Another treadmill exercising device of interest is to be found in U.S. Pat. No. 4,066,257, which issued to B. Moller on Jan. 3, 1978. The Moller treadmill also addresses the storage problem by designing the device for movement between a horizontal operative position and an upright storage position. A cabinet is mounted with the treadmill so that movement of the cabinet to an upright storage position causes the treadmill to also move to the upright position and be concurrently concealed by the cabinet. Again, however, the problem of easily transporting the treadmill to a new location is not addressed.

As such, it can be appreciated that there is a continuing need for new and improved treadmill exercising devices which address both the problem of storage and portability, and in this respect, the present invention substanially fulfills this need.

SUMMARY OF THE INVENTION

In view of the foregoing disadvantages inherent in the known types of treadmill excercising devices now present in the prior art, the present invention provides an improved treadmill exercising device wherein the same can be compactly stored when not in use and can further be easily and efficiently transported during such periods of non-use. As such, the general purpose of the present invention, which will be described subsequently in greater detail, is to provide a new and improved treadmill exercising device which has all the advantages of the prior art treadmill exercising devices and none of the disadvantages.

To attain this, the present invention comprises a treadmill which may be compactly folded in half during periods of non-use. A telescoping handle assembly controls the tensioning of the treadmill belt, so that a collapse of the handle assembly releases belt tension. With the belt tension so released, the treadmill may be easily folded in half and fastened together to facilitate its movement.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved treadmill exercising apparatus which has all the advantages of the prior art treadmill exercising apparatuses and none of the disadvantages.

It is another object of the present invention to provide a new and improved treadmill exercising apparatus which may be easily and efficiently manufactured and marketed.

It is a further object of the present invention to provide a new and improved treadmill exercising apparatus which is of a durable and reliable construction.

An even further object of the present invention is to provide a new and improved treadmill exercising apparatus which is susceptible of a low cost of manufacture with regard to both materials and labor, and which accordingly is then susceptible of low prices of sale to the consuming public, thereby making such treadmill exercising apparatuses economically available to the buying public.

Still yet another object of the present invention is to provide a new and improved treadmill exercising apparatus which provides in the apparatuses and methods of the prior art some of the advantages thereof, while simultaneously overcoming some of the disadvantages normally associated therewith.

Still another object of the present invention is to provide a new and improved treadmill exercising apparatus which may be completely stored when not being utilized.

Yet another object of the present invention is to provide a new and improved treadmill exercising apparatus which may be folded in half to facilitate a transporting thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional side elevation view thereof.

FIG. 4 is a side elevation view of the invention showing the manner of folding it into a storage position.

DESCRIPTION OF THE PREFERRED EMBODIMENT

Figure 1:
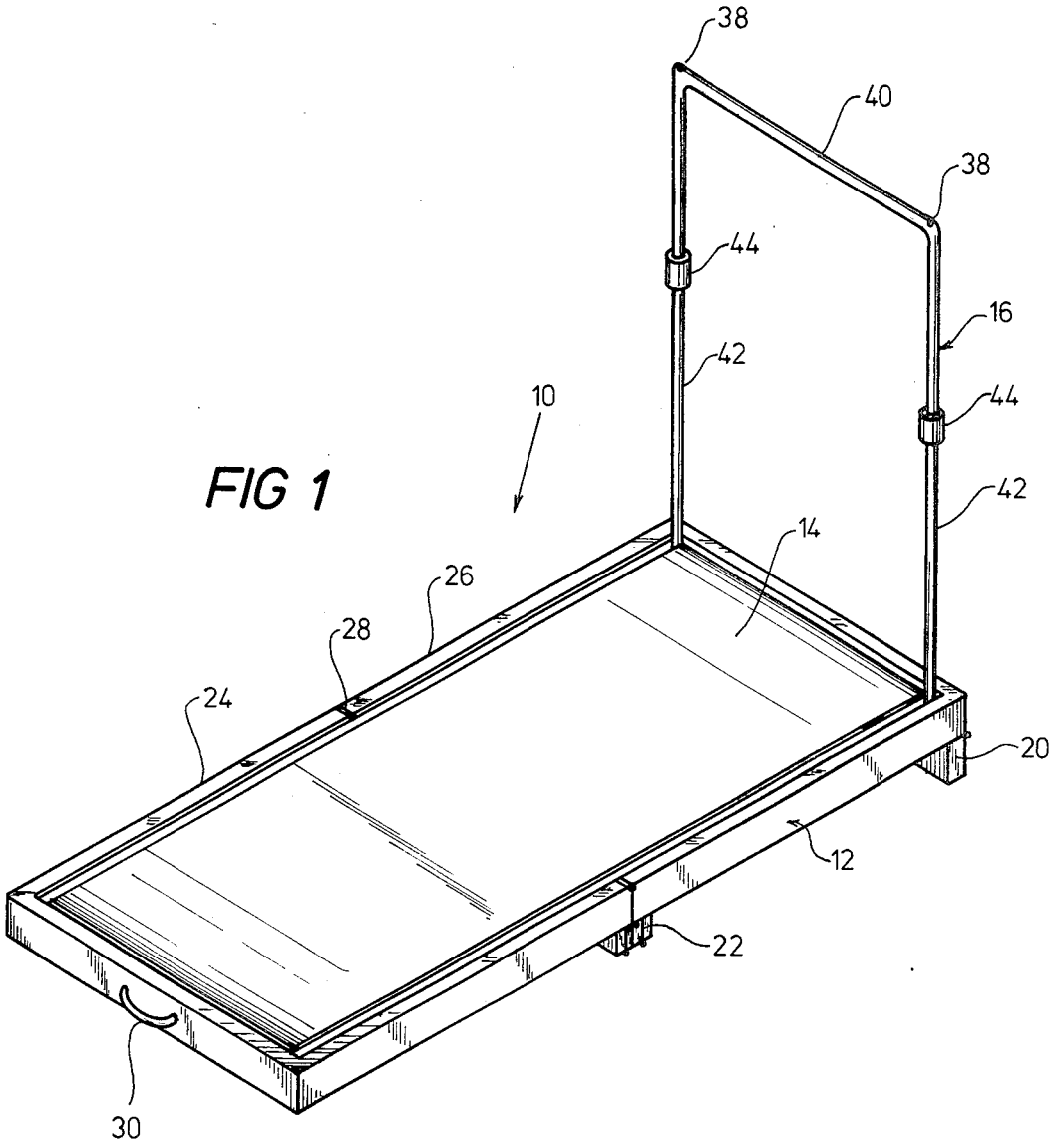
FIG. 1 is a perspective view of the treadmill exercising apparatus comprising the present invention.
Figure 3:
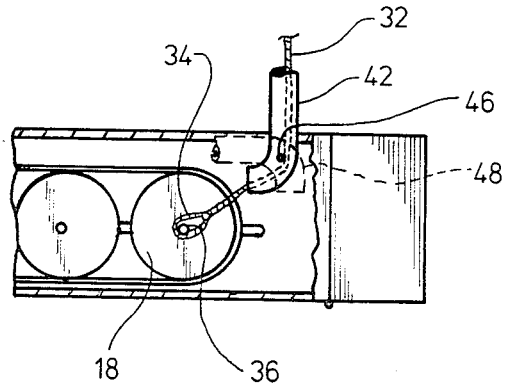
FIG. 3 is a cross-sectional detail view of the invention.

With reference now to the drawings, and in particular to FIGS. 1, 2 and 3 thereof, a new and improved treadmill exercising apparatus embodying the principles and concepts of the present invention and generally designated by the reference numeral 10 will be described.

More specifically, it will be noted that the treadmill exercising apparatus 10 essentially comprises a conventional exercising treadmill 12 which includes a movable exercising belt 14 and a telescoping support handle assembly 16. As best illustrated in FIG. 2, the belt 14 is of a continuous construction and is positionable over a plurality of horizontally aligned rollers 18. The belt 14 is movable in a continuous manner over the rollers 18 in response to user provided momentum.

The treadmill 12 further includes forward support legs 20 and intermediate support legs 22, with the forward support legs 20 being of a greater height so as to provide a gradual upward slope to the treadmill. The treadmill housing 12 is divided into two sections 24, 26 which are pivotally attached together by an intermediate hinge assembly 28. The housing section 24 includes a handle 30 on one end thereof, while the belt 14, of course, extends across the rollers 18 located in both housing sections.

Figure 5:
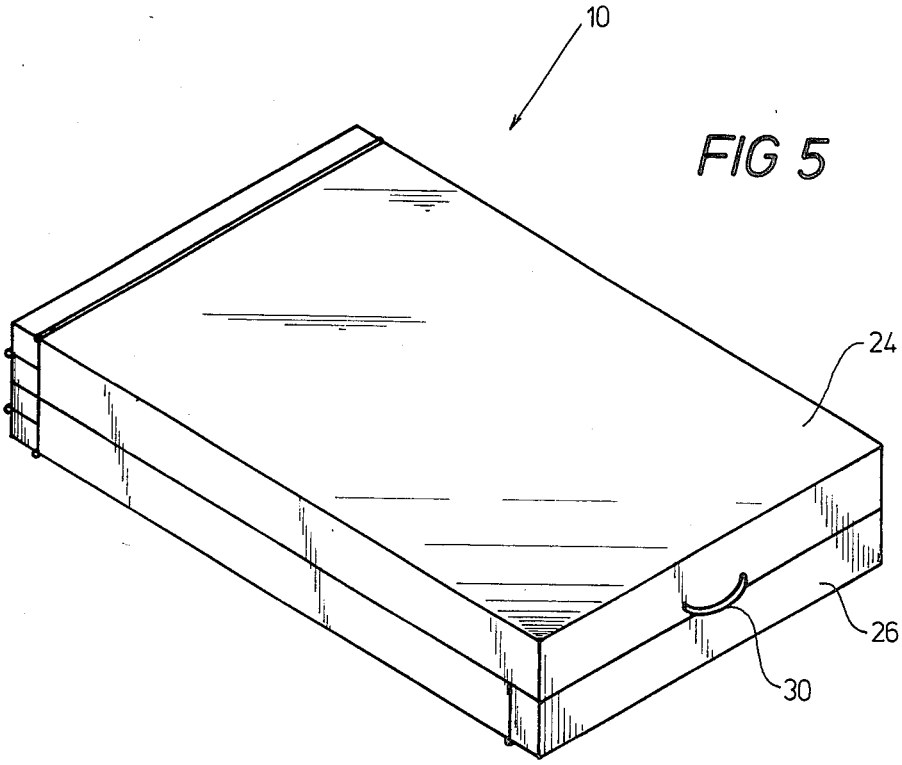
FIG. 5 is a perspective view of the apparatus in its folded storage position.
Figure 6:
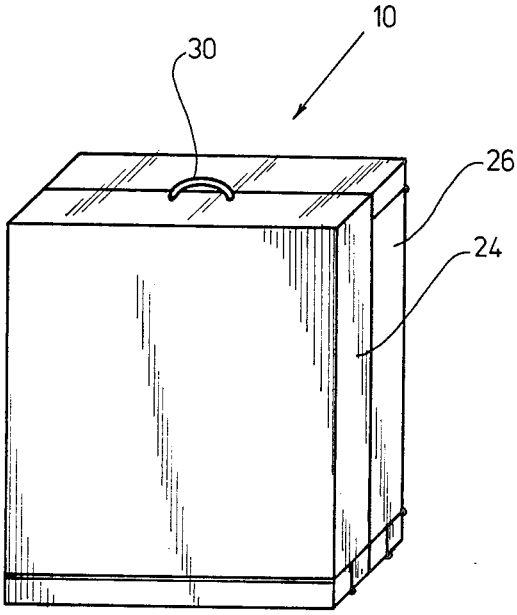
FIG. 6 is a perspective view of the apparatus in an upright stored position.
Figure 7:
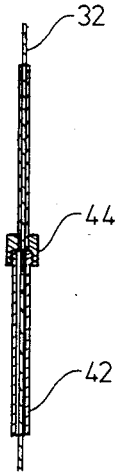
FIGS. 7, and 8 show the cables in the handle.
Figure 8:
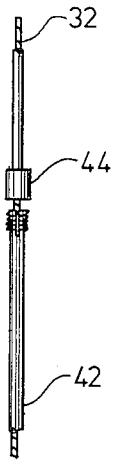

As illustrated in FIG. 4, the housing sections 24, 26 are foldable towards each other to achieve the compact folded condition as illustrated in FIGS. 5 and 6. The tension device is not necessary in all cases. If the hinge is in the proper location, it will work as a tension device providing the belt has just a little elasticity. Therefore it would be well to have that as an option in this design. Inasmuch as such folding would not be possible when the belt 14 is in a tensioned condition over the rollers 18, a belt tension release means is defined by a pair of cables 32 which have their first free ends 34 positioned over an axle 36 associated with a first roller 18, with the remaining free ends 38 of the cables being fixedly secured to a topmost section 40 of the handle assembly 16. In this regard, the handle section 40 is telescopingly positioned in a second handle section 42, and conventional hand tightenable locking members 44 are used to obtain the desired relative postioning between the handle sections.

Inasmuch as the rollers 18 are slidably movable within the treadmill housing 12 into an extended spaced-apart relationship to effect tensioning of the belt 14, as best illustrated in FIG. 2, it can be noted that a collapsible release of the handle section 40 into the handle section 42 will result in a concurrent release of tension on the pair of cables 32. The cables 32 hold the rollers 18 in a spaced-apart relationship, with the rollers then being movable into abutment with each other when cable tension is released. This concurrently results in a release of tension on the belt 14 so that the treadmill housing sections 24, 26 can be folded together as illustrated in FIGS. 4, 5 and 6. At the same time, the lower handle section 42 may be rotated about a pivot 46 so as to move it into a downward stored position as generally designated by the reference numeral 48 in FIG. 3. The housing section 24 then folds downwardly over the handle assembly 16 to complete the construction of the folded storage container, as shown in FIGS. 5 and 6, and appropriate conventional locking means may then be utilized to hold the container in its closed position.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable treadmill exercising device, comprising:

a. treadmill housing means comprising first and second housing sections pivotally attached together, said first and second housing sections being relatively movable into an extended abuttable position to define an operative use position of said treadmill excercising device and a folded collapsed position to define a portable inoperative use position of said device;

b. continuous belt means positioned over a plurality of rollers mounted in said treadmill housing means, each of said plurality of rollers having an axle extending therethrough;

c. support handle means to provide support to a user of said portable treadmill exercising device; and, d. belt tensioning means positioned in said support handle means, said belt tensioning means faciltating a tensioning of said belt means during a use of said treadmill exercising device and a release of said tensioning during a folding of said treadmill housing means into said inoperative use position.

2. The portable treadmill exercising device of claim 1, wherein said support handle means is of a telescoping selectively lockable construction, said support handle means being movable into an extended position to effect said tensioning of said continuous belt means and into a collapsed position to effect a release of said tensioning of said continuous belt means.

3. The portable treadmill exercising device of claim 2, wherein said belt tensioning means further includes at least one cable fastened between said support handle means and at least one of said axles of said plurality of rollers, wherein an extension of said support handle means results in an increase of tension on said at least one cable thereby causing an increase of tension on said belt means.

4. The portable treadmill exercising device as described in claim 3, wherein said support handle means may be collapsed into an abutting relationship with said second housing section during a movement of said first and second housing sections into abutment to define said inoperative use position.

* * * * *